US012796827B2

(12) United States Patent
Troy

(10) Patent No.: US 12,796,827 B2
(45) Date of Patent: Nov. 17, 2026

(54) BEDDING CONNECTION DEVICE, BEDDING SYSTEM AND PROCESS FOR CHANGING OF BED SHEETS

(71) Applicant: Matthew Jayson Troy, Albany, NY (US)

(72) Inventor: Matthew Jayson Troy, Albany, NY (US)

( * ) Notice: Subject to any disclaimer, the term of this patent is extended or adjusted under 35 U.S.C. 154(b) by 0 days.

(21) Appl. No.: 18/780,672

(22) Filed: Jul. 23, 2024

(65) Prior Publication Data

US 2025/0031861 A1 Jan. 30, 2025

Related U.S. Application Data

(60) Provisional application No. 63/515,300, filed on Jul. 24, 2023.

(51) Int. Cl.

| | |
|---|---|
| ***A47C 21/02*** | (2006.01) |
| ***A47C 31/10*** | (2006.01) |
| ***A47G 9/02*** | (2006.01) |

(52) U.S. Cl.

CPC ..... *A47C 21/022* (2013.01); *A47C 31/105* (2013.01); *A47G 9/0238* (2013.01)

(58) Field of Classification Search

CPC ..... A47G 9/02; A47G 9/0238; A47G 9/0246; A47C 31/105; A47C 21/02; A47C 21/022

See application file for complete search history.

(56) References Cited

U.S. PATENT DOCUMENTS

| | | | | | |
|---|---|---|---|---|---|
| 557,456 | A * | 3/1896 | Utter | A47C 21/022 | 24/72.5 |
| 1,365,169 | A * | 1/1921 | Goldberg | A47C 21/022 | 24/72.5 |
| 1,602,305 | A * | 10/1926 | Helm | A44B 17/00 | 24/72.5 |
| 1,928,943 | A * | 10/1933 | Mckay | A47C 31/105 | 5/499 |
| 2,024,050 | A * | 12/1935 | May | A47C 21/022 | 24/72.5 |
| 2,129,487 | A * | 9/1938 | Bleier | A47D 15/02 | 24/72.5 |
| 2,630,587 | A * | 3/1953 | Brown | A47C 31/105 | 5/692 |

(Continued)

FOREIGN PATENT DOCUMENTS

| | | | | |
|---|---|---|---|---|
| EP | 3319484 B1 * | 4/2022 | ..... | A47C 21/022 |
| FR | 2692123 A1 * | 12/1993 | ..... | A47C 21/022 |
| KR | 100745476 B1 * | 8/2007 | ..... | A47G 9/04 |

*Primary Examiner* — David E Sosnowski

(74) *Attorney, Agent, or Firm* — McGlew and Tuttle, P.C.

(57) ABSTRACT

A bedding connection device for applying bedding to a mattress. The device has a mattress cover configured to be fitted with the mattress over corners of the mattress, a plurality of cover fastener parts connected to the mattress cover at locations coinciding with or adjacent to the corners of the mattress, a sheet configured to sit atop the mattress cover and having corner portions to be positioned at or adjacent to the corners of the mattress, and a plurality of sheet fastener parts respectively connected to the sheet at locations coinciding with or adjacent to the corners of the sheet. Each of the sheet fastener parts being connectable with an associated one of the cover fasteners parts.

16 Claims, 9 Drawing Sheets

(56) References Cited

U.S. PATENT DOCUMENTS 2,931,084 A * 4/1960 De Witt ..... A47C 31/105 24/72.5
3,083,378 A * 4/1963 Pursell ..... A47C 21/022 5/413 R
3,092,848 A * 6/1963 Gronvold ..... A47C 21/022 24/72.5
3,831,206 A * 8/1974 Geary ..... A47G 9/086 5/413 R
4,646,375 A * 3/1987 Parker ..... A47G 9/0246 5/923
4,662,016 A * 5/1987 Seeman ..... A47C 21/022 24/72.5
4,782,543 A * 11/1988 Hutton ..... A47C 27/085 24/72.5
4,829,617 A * 5/1989 Dameron ..... A47C 21/022 24/72.5
4,899,407 A * 2/1990 McCue ..... A47C 21/022 24/72.5
4,937,904 A * 7/1990 Ross ..... A47G 9/0246 24/72.5
5,014,399 A * 5/1991 Grisel ..... A47C 21/022 24/72.5
5,161,276 A * 11/1992 Hutton ..... A47C 21/022 24/72.5
5,321,862 A * 6/1994 Campbell ..... A47C 21/022 5/923
6,161,235 A * 12/2000 Smith ..... A47C 21/022 5/498
6,233,764 B1 * 5/2001 Orr ..... A47G 9/0246 5/692
6,253,398 B1 * 7/2001 Yim ..... A47C 31/105 5/497
7,152,260 B2 * 12/2006 Ota ..... A47C 21/022 24/72.5
7,827,633 B2 * 11/2010 Taylor ..... A47C 21/022 5/500
8,453,280 B2 * 6/2013 Martray ..... A47G 9/086 5/413 R
8,464,377 B1 * 6/2013 Carson ..... A47G 9/0261 24/72.5
12,201,221 B2 * 1/2025 Adjesson ..... A47G 9/0223
2002/0062524 A1 * 5/2002 Vogland ..... A47C 21/022 5/692
2012/0233776 A1 * 9/2012 Agarwall ..... A47C 31/105 5/496
2013/0180050 A1 * 7/2013 Koci ..... A47G 9/02 5/496
2013/0283528 A1 * 10/2013 Tzur ..... A47C 21/022 5/498
2018/0303256 A1 * 10/2018 Sturgeon ..... A47C 21/022
2019/0099018 A1 * 4/2019 Holt ..... A47G 9/0238
2022/0133052 A1 * 5/2022 Adjesson ..... A47G 9/0223 5/498
2022/0287468 A1 * 9/2022 Blatt ..... A47C 21/02
2024/0206635 A1 * 6/2024 Rubin ..... A47C 21/026

* cited by examiner

BEDDING CONNECTION DEVICE, BEDDING SYSTEM AND PROCESS FOR CHANGING OF BED SHEETS

CROSS REFERENCE TO RELATED APPLICATIONS

The application claims the benefit of priority under 35 U.S.C. § 120 of U.S. provisional patent application 63/515,300, filed Jul. 24, 2023, the entire contents of which are incorporated herein by reference.

FIELD OF THE INVENTION

The invention relates to generally to bedding such as bottom sheets, top sheets and mattress covers and more particularly to a bedding connection device, bedding system and process for changing of bed sheets.

BACKGROUND OF THE INVENTION

Devices or systems designed for beds typically include fitted sheets, top sheets, and blankets. The size, arrangement, style, and fabric may influence the functions of the various bed-covering components. A conventional fitted sheet may be elastically gathered at the corners of the curtain portions of the sheet so as to fit snugly about and cover a complementary-sized mattress. A top sheet can be made of cotton or other suitable fabric, may comprise a flat rectangle of fabric that lies on top of the fitted sheet, and may provide a light covering for a person positioned between the fitted sheet and the top sheet. In some cases, a third covering, such as a blanket, can be provided atop the top sheet for added warmth. However, most such devices or systems currently lack proper fastening mechanisms. Thus, there is a need to develop a system to solve such problems.

SUMMARY OF THE INVENTION

The object of the invention is to provide an improved bedding connection device, bedding system and process for changing of bed sheets.

According to the invention, a bedding connection device is provided for applying bedding to a mattress. The device comprises a mattress cover, wherein the mattress cover is configured as a fitted mattress cover, to be fitted with the mattress over corners of the mattress. A plurality of cover fastener parts are connected to the mattress cover at locations coinciding with or adjacent to the corners of the mattress. A sheet is configured to sit atop the mattress cover and has corner portions to be positioned at or adjacent to the corners of the mattress. A plurality of sheet fastener parts respectively connect to the sheet at locations coinciding with or adjacent to the corners of the sheet. Each of the sheet fastener parts is connectable with an associated one of the cover fasteners parts.

The bedding connection may further comprise straps connected to the mattress cover at anchoring points. Each of the cover fastener parts is connected to the mattress at locations coinciding with or adjacent to the corners of the mattress by a respective strap. This allows movement of the cover fastener parts relative to the anchor points. Each of the straps are configured with a cover fastener part adjustment arrangement to adjust a position of the cover fastener part relative to the respective anchoring point and/or comprises an elastic strap to adjust a position of the cover fastener part relative to the respective anchoring point.

The cover fastener part adjustment arrangement may comprise a strap adjuster connected to the respective cover fastener part, the strap adjuster comprises a plurality of strap passage openings to adjust a position of the respective cover fastener part along a length of the respective strap.

The anchoring points may comprise a stitched connection of the strap to the mattress cover. This may also comprise a reinforced portion supporting and/or covering the connection of the respective strap and the mattress cover.

The cover fastener parts may each comprise a buckle clip defining a latching clip opening with a latching clip and the sheet fastener parts each comprise a knob-shaped stud configured to be received in the latching clip opening and retained therein with the latching clip. Upon connection of the cover fastener parts with the respective sheet fastener parts the sheet is held in position relative to the mattress cover.

The cover fastener parts may each comprise one of a hook or loop, or hook and loop fastener portion. The sheet fastener parts may also each comprise another of a hook or loop, hook and loop fastener portion. Upon connection of the cover fastener parts with the respective sheet fastener parts the sheet is held in position relative to the mattress cover. The sheet is reinforced at locations at which the sheet fastener parts are connected to the sheet.

The bedding connection device may further comprise an upper bedding part such as a top sheet configured to sit atop the sheet and having corner portions to be positioned at or adjacent to the corners of the sheet. A plurality of top sheet fastener parts are respectively connected to the top sheet at locations coinciding with or adjacent to two of the corners of the top sheet. Each of the top sheet fastener parts is connectable with an associated cover fastener part. The top sheet is reinforced at locations at which the top sheet fastener parts are connected to the top sheet. The top sheet may also comprise a fastener cover portion to at least partially cover the respective top sheet fastener. It maybe advantageous for the cover sheet to be wider on the sides and to drape down over a portion of the mattress. Additionally, because the cover sheet has a longer width than the fitted sheet, the top sheet has its connection points inward a bit from its own corners, but still positioned at the two bottom corners of the mattress. It is also advantageous for the top sheet to use grommets to connect into place.

According to the invention the process comprises various steps including providing a mattress cover. The mattress cover is configured to be fitted with the mattress over corners of the mattress. A plurality of cover fastener parts connected to the mattress cover are provided at locations coinciding with or adjacent to the corners of the mattress. Additionally, a sheet configured to sit atop the mattress cover and having corner portions positioned at or adjacent to the corners of the mattress is provided. Furthermore, a plurality of sheet fastener parts connected to the sheet at locations coinciding with or adjacent to the corners of the sheet are provided. Each of the sheet fastener parts is connectable with an associated cover fastener part. The cover is applied to the mattress, and then the sheet is applied to sit atop the mattress. Lastly, connect the respective cover fastener parts to the respective sheet fastener parts.

The process for changing sheets of a mattress further comprises providing straps connected to the mattress cover at anchoring points. Each of the cover fastener parts are connected to the mattress at locations coinciding with or adjacent to the corners of the mattress by a respective strap. This allows movement of the cover fastener parts relative to the anchor points.

Each of the straps are configured with a cover fastener part adjustment arrangement to adjust a position of the cover fastener part relative to the respective anchoring point. The process may also comprise providing an elastic strap to adjust a position of the cover fastener part relative to the respective anchoring point based on the elastic strap returning toward an unstretched position.

The cover fastener part adjustment arrangement may comprise a strap adjuster connected to the respective cover fastener part. The strap adjuster comprises a plurality of strap passage openings to adjust a position of the respective cover fastener part along a length of the respective strap.

The anchoring points may comprise a stitched connection of the strap to the mattress cover and/or a reinforced portion that supports and/or covers the connection between the respective strap and the mattress cover.

The cover fastener parts may each comprise a buckle clip defining a latching clip opening with a latching clip and the sheet fastener parts each comprise a knob-shaped stud configured to be received in the latching clip opening and retained therein with the latching clip. Upon connection of the cover fastener parts with the respective sheet fastener parts the sheet is held in position relative to the mattress cover.

The cover fastener parts each comprise one of a hook or a loop configuration, hook and loop fastener portion. Further, the sheet fastener parts also each comprise the another of the hook or the loop configuration, hook and loop fastener portion, whereby upon connection of the cover fastener parts with the respective sheet fastener parts the sheet is held in position relative to the mattress cover. The sheet is reinforced at locations at which the sheet fastener parts are connected to the sheet.

The process for changing sheets further provides a top sheet configured to sit atop the sheet with the top sheet having corner portions to be positioned at or adjacent to the corners of the sheet. Additionally, a plurality of top sheet fastener parts are respectively connected to the top sheet at locations coinciding with or adjacent to two of the corners of the top sheet, each of the top sheet fastener parts being connectable with an associated one of two of the cover fastener parts.

The invention also provides a system for applying bedding to a mattress. The system comprises a mattress and a mattress cover. The mattress cover is configured to be fitted with the mattress over corners of the mattress. A plurality of cover fastener parts are connected to the mattress cover at locations coinciding with or adjacent to the corners of the mattress. A sheet is configured to sit atop the mattress cover and have corner portions to be positioned at or adjacent to the corners of the mattress. Lastly, a plurality of sheet fastener parts are respectively connected to the sheet at locations coinciding with or adjacent to the corners of the sheet. Each of the sheet fastener parts are connectable with an associated one of two of the cover fasteners parts.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 2 is an enlarged top view showing a portion of the sheet with fastener part including a stud (knob);

FIG. 3A is an enlarged side view showing a cover fastener part including a fastener with actuator and having a strap opening;

DESCRIPTION OF THE PREFERRED EMBODIMENTS

Figure 1:
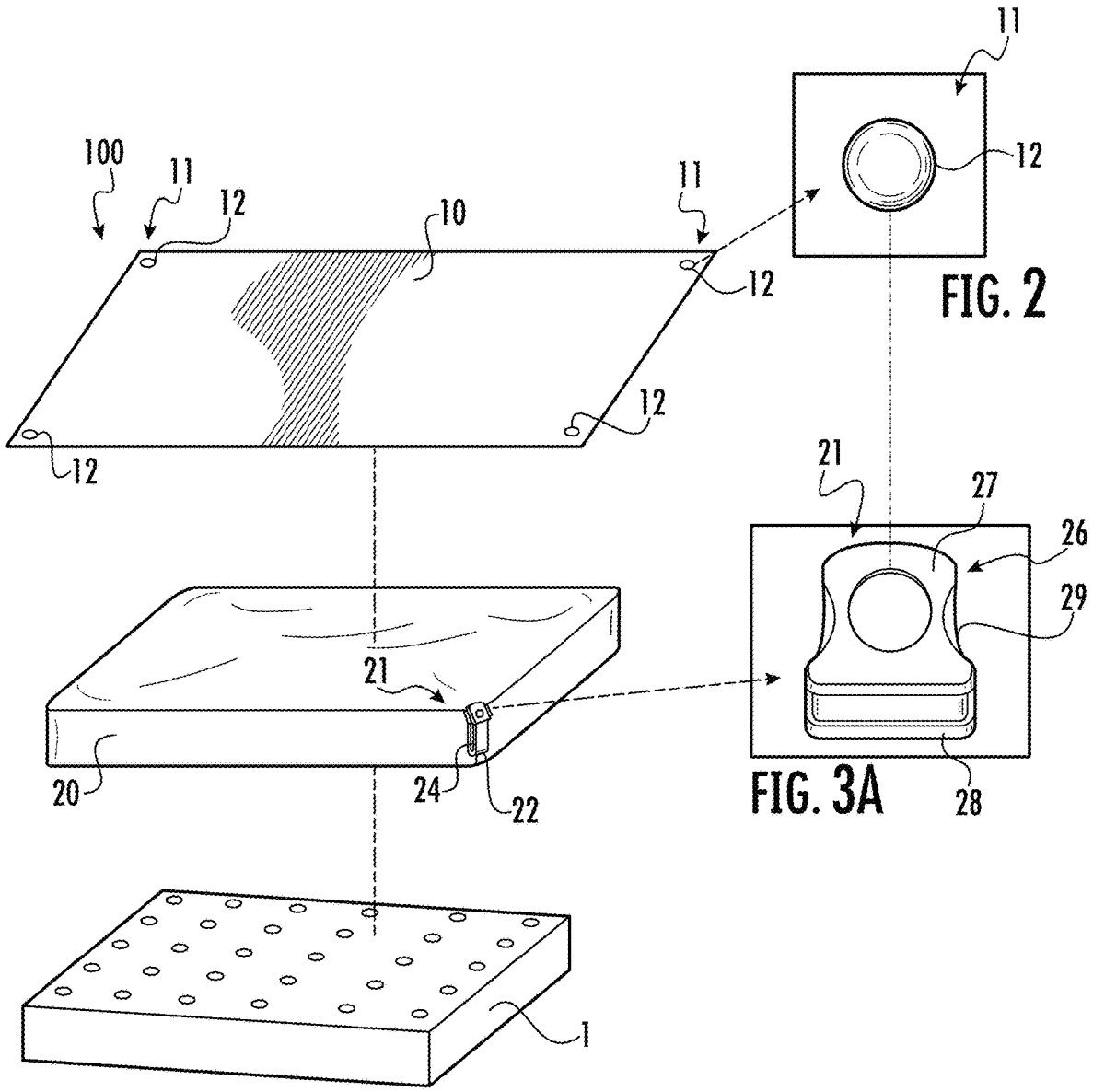
FIG. 1 is an exploded view of the bedding system according the invention, showing features of the bedding connection device according to the invention.

Referring to the drawings in particular, the invention comprises a bedding connection device generally designated 100, for use with a mattress designated 1. The bedding connection device forms a bedding system 120 (FIG. 10) for use with the mattress 1 The bedding connection device 100 includes a sheet (bottom sheet) 10 which cooperates with a mattress cover 20.

The mattress cover 20 is preferably in the form of a fitted mattress cover 20, namely with elastic corners so as to be fitted on the mattress 1. The mattress 1 may be of various sizes such as a queen-size, king-size or the like, with the mattress cover 20 being of appropriate dimensions to provide the fit.

The mattress cover 20 includes a cover fastener part generally designated 21. The cover fastener part 21 comprises a fastener 26. The fastener part 21 is further associated with a strap 24 which connects the fastener 26 to an anchoring point 22. The anchoring point 22 is advantageously a stitching configuration that binds the strap 24 to the mattress cover, so as to fix an end of the strap 24 to the mattress cover. The mattress cover 20 may be reinforced with rip stop material in the region of the anchoring point 22. The reinforcement may include a pocket structure 25 (FIG. 5) formed around the strap 24 and configured to receive a loose end of the strap 24. The fastener 26 comprises a buckle clip with a latching clip opening 27. The buckle clip is a spring loaded moveable latch that is actuated by an actuator 29. The actuator 29 is spring-loaded so as to move to a latching position (a latching state) upon release of the actuator 29. The buckle clip 26 may be moved to an open position (open state) by pressing the actuator 29 from an outer surface.

The sheet 10 includes a plurality of sheet fastener parts 11. Each fastener part 11 includes a base portion 14 (FIG. 7) which is fixed to the sheet 10 at an anchor location 13 of the sheet 10. The anchor locations may be reinforced with extra fabric (a rip stop material), with the base part 14 being held or otherwise fixed to the sheet 10. The fastener part 11 also includes a knob-shaped stud/post 12, that extends from the base portion 14. A metal screw/nail goes through a washer and is then pressed through the fabric and into the knob-shaped stud/post (stud 12). The fabric is reinforced in anchor location areas (13, 22, 44) with a rip-stop material to ensure the durability of the stud (knob) attachment 44 (or other attachment) to the sheet. On the top side of the sheet 10, sandwiched in between the fabric and the stud 12, a silicone spacer 14/16 is provided that is embossed with corner directions (upper left/lower right, and upper right/lower left). The stud 12 has a shape that cooperates with the latching opening 27 of the fastener 26.

Figure 3B:
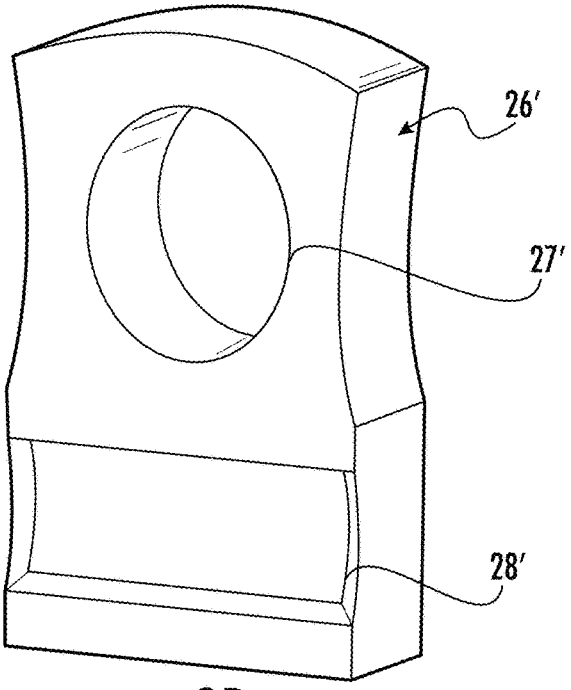
FIG. 3B is a perspective view showing an alternative cover fastener part including a fastener with no actuator and having a strap opening.
Figure 3C:
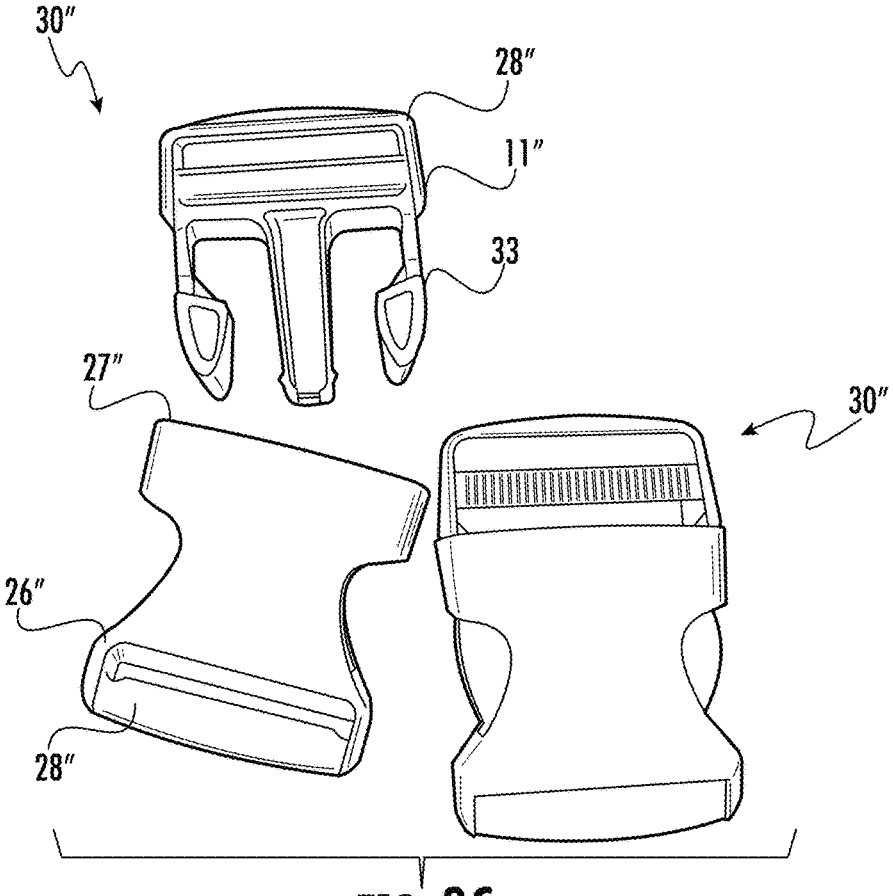
FIG. 3C is an enlarged view showing alternative cover fastener parts including a fastener with flexible male part actuator and receiving clip with each having a strap opening.

As an alternative, the cover fastener part 21 may comprise a fastener 26' with no actuator (FIG. 3B). The opening 27' receives the stud 12. The strap 24 is tightened and the stud is held in the opening 27', with this particularly facilitated by the shape of the upper end of the stud 12 and by the shape of the opening 27, 27'. The strap may instead be elastic with the elastic strap 24 acting on the fastening parts such that the stud 12 is held in the opening 27'. As mentioned above, the cover fastener parts 21 may each comprise one of a hook or a loop configuration of a hook and loop fastener portion (VELCRO), and the sheet fastener parts 11 may each comprise another of a hook or a loop configuration of a hook and loop fastener portion (VELCRO). These VELCRO portions may be provided at the anchor locations 13 for the sheet fastener parts 11 and at edge locations of the mattress cover 10 for the cover fastener parts 21. This embodiment does not require an adjustment feature as the hook and loop fastener portions (VELCRO portions) may be sized to allow some sheet 10 to mattress cover 20 adjustment based on moving the connection of the hook or loop fastener (VELCRO) portions relative to each other. As a further alternative, the cover fastener part 21 may comprise a fastener 26" that has a cooperating sheet fastener 11', (FIG. 3C).' This fastener configuration 11", 26" may be a so-called back pack fastener configuration. The actuator is flexible male part actuator 33 that cooperates with an opening 27" in a receiving clip 26". The clip 26" may also have a strap opening 28". The fastener 11" with the male part actuator 33 may also comprise a strap opening 28" to provide an adjustment arrangement 30". With each fastener embodiment, upon connection of the cover fastener parts 21 with the respective sheet fastener parts 11 the sheet is held in position relative to the mattress cover.

The mattress cover 20 advantageously includes a cover fastener part 21 at each of the four corners of the mattress cover 20. Likewise the sheet 10 includes four sheet fasteners 11 at the corners of the sheet 10. With this configuration each of the sheet fasteners parts 11 is fixedly connected to a respective one of the cover fasteners 21 based on the stud being received in the latching opening 27. This is done with the actuator 29 being pressed from the outside to further open the latching opening 27 to receive the stud 12. The actuator 29 is released which captures the stud 12 in the latching opening 27.

Figure 4:
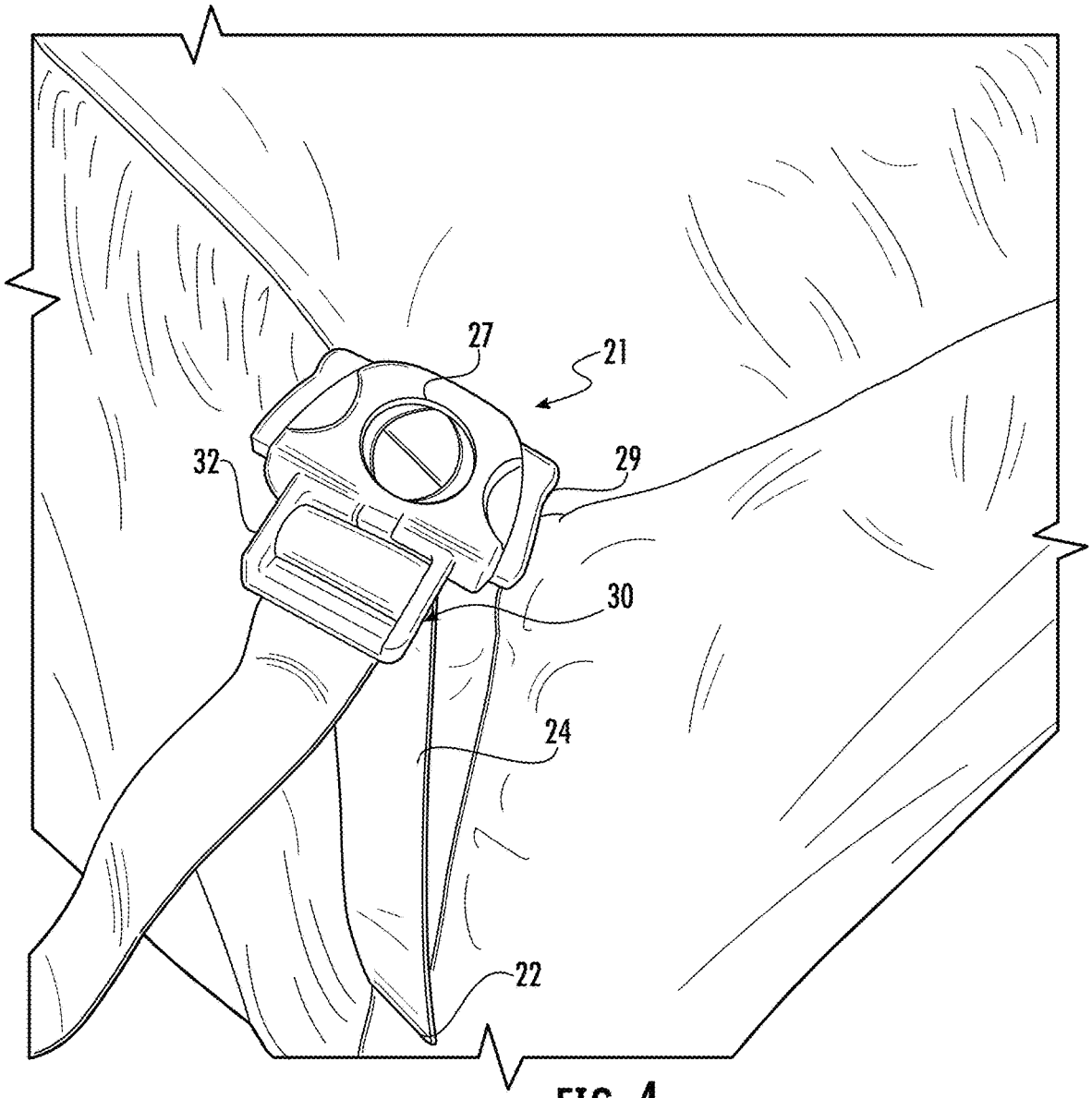
FIG. 4 is a perspective view showing a mattress cover of the invention with a strap connected to the mattress cover at a corner anchor point and including a cover fastener with a cover fastener part adjustment arrangement.

FIG. 4 shows the strap 24 fixed at the anchor location 22 with the cover fastener 21 extending a distance from the anchor point 22. The bedding connection device 100 and the bedding system 120 may be provided with an adjusting arrangement 30 which forms a part of the cover fastener 21. This adjusting arrangement 30 may comprise a strap adjuster 32 which includes strap passage openings which allow the strap 24 to pass through the openings and set a position of the strap 24 relative to the strap adjuster 32, such that a length of the strap may be adjusted to vary a distance of the cover fastener 21 from the strap anchoring point 22. An alternative arrangement may be provided wherein the strap 24 is elastic and has a predefined length extending from the anchoring point 22 to the cover fastener 21. This length may be predetermined or predefined relative to the stretch characteristics of the elastic strap 24 so as to allow an extension of the elastic strap 24, due to the elastic nature, allowing a positioning of the fastener 21 for connection with the fastener 11. This elastic aspects of the strap 24 may be such that the a user may stretch the fastener part 21 into a predefined location to engage the fastener part 11 and then allow the strap 24 to return towards the original length based on the elastic nature of the elastic strap 24.

Figure 5:
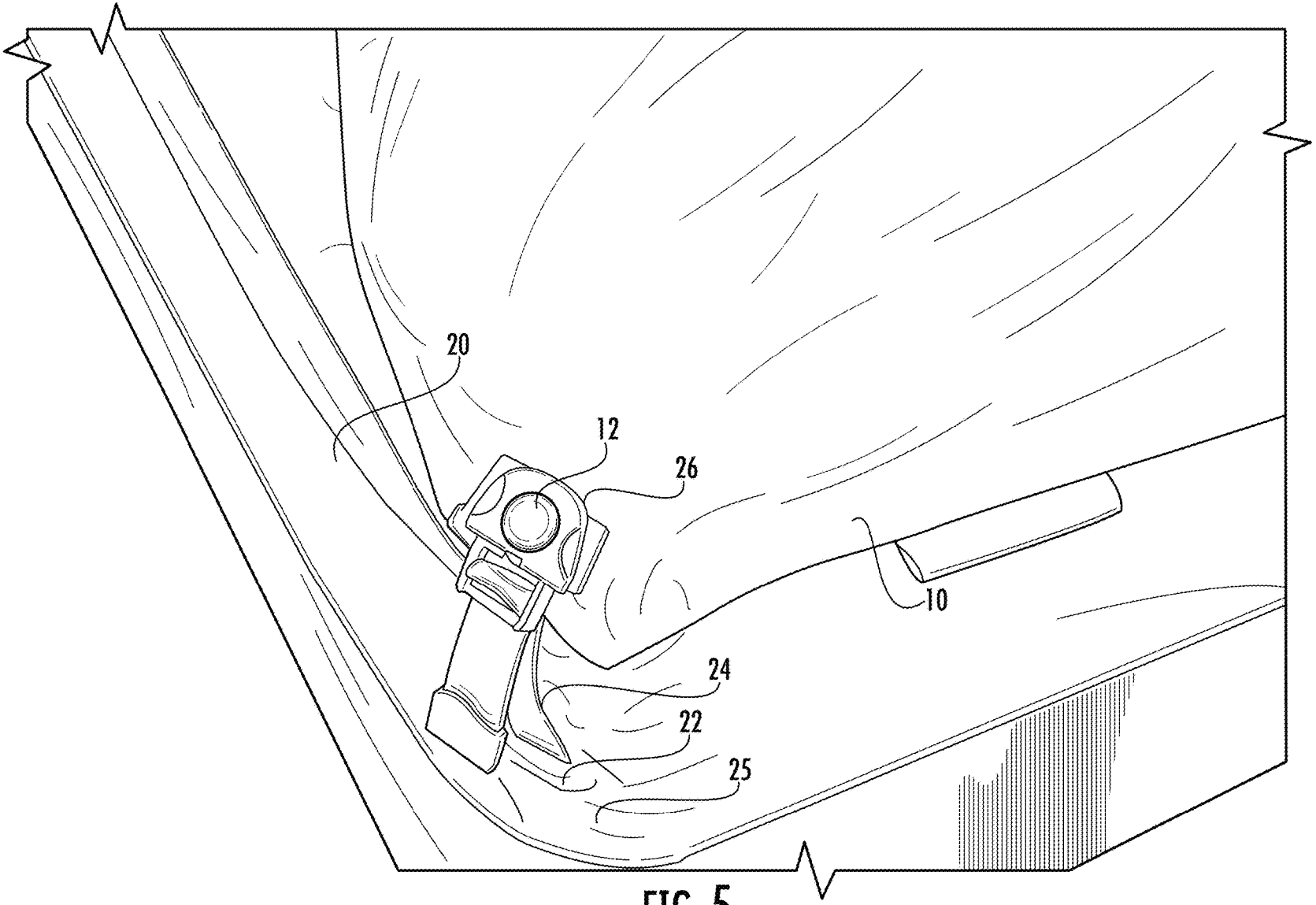
FIG. 5 is a perspective view showing a sheet (bottom sheet) with a sheet fastener part connected to a respective cover fastener part at one corner of the mattress cover.

FIG. 5 shows the bottom sheet 10 subsequent to a connection of the cover fastener 21 to the sheet fastener 11. In the view of FIG. 5 the cover fastener part 21 is shown after using the adjustment arrangement 30 to adjust the length of the strap 24 so as to bring the cover sheet to a location over the edge of the mattress 1, such that the sheet (bottom sheet) 10 is sufficiently taught and in position on top of the mattress cover 10. After adjustment, an end of the strap 24 may be tucked into the pocket feature 25 that is part of the anchor point 22. With the strap 24 as an elastic strap 24, after connecting the cover fastener 21 to the sheet fastener 11, the elastic nature of the strap 24 pulls the fastener and the sheet to the appropriate location, namely with the sheet 10 at a location over the edge of the mattress 20 one such that the sheet (bottom sheet) 10 is sufficiently taught and in a desired position atop the mattress cover 20.

Figure 6:
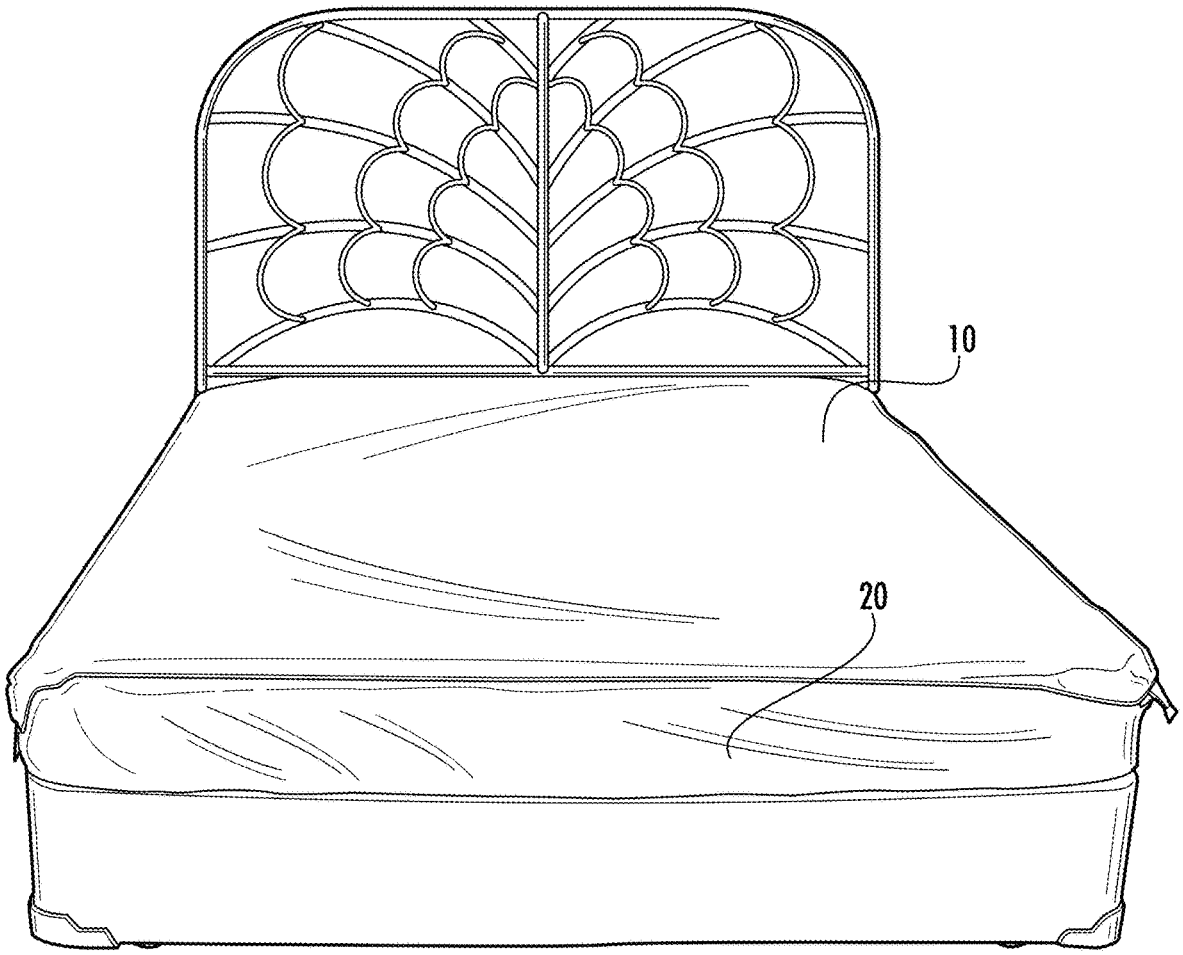
FIG. 6 is a perspective view showing a sheet attached to corners to a mattress cover based on each of the four cover fastener parts being connected to respective sheet fastener parts.

FIG. 6 shows the sheet 10 atop the mattress cover 20 with each of the cover fasteners 21 connected to the respective sheet fasteners 11. FIG. 6 shows the state after the process steps including providing the cover and attaching it appropriately to the mattress 1, providing the sheet 10 and fixing the various cover fasteners 21 to the various sheet fasteners 21 to complete basic process of the invention of changing the bed sheets, namely applying a new (fresh-freshly cleaned) sheet 10.

Figure 7:
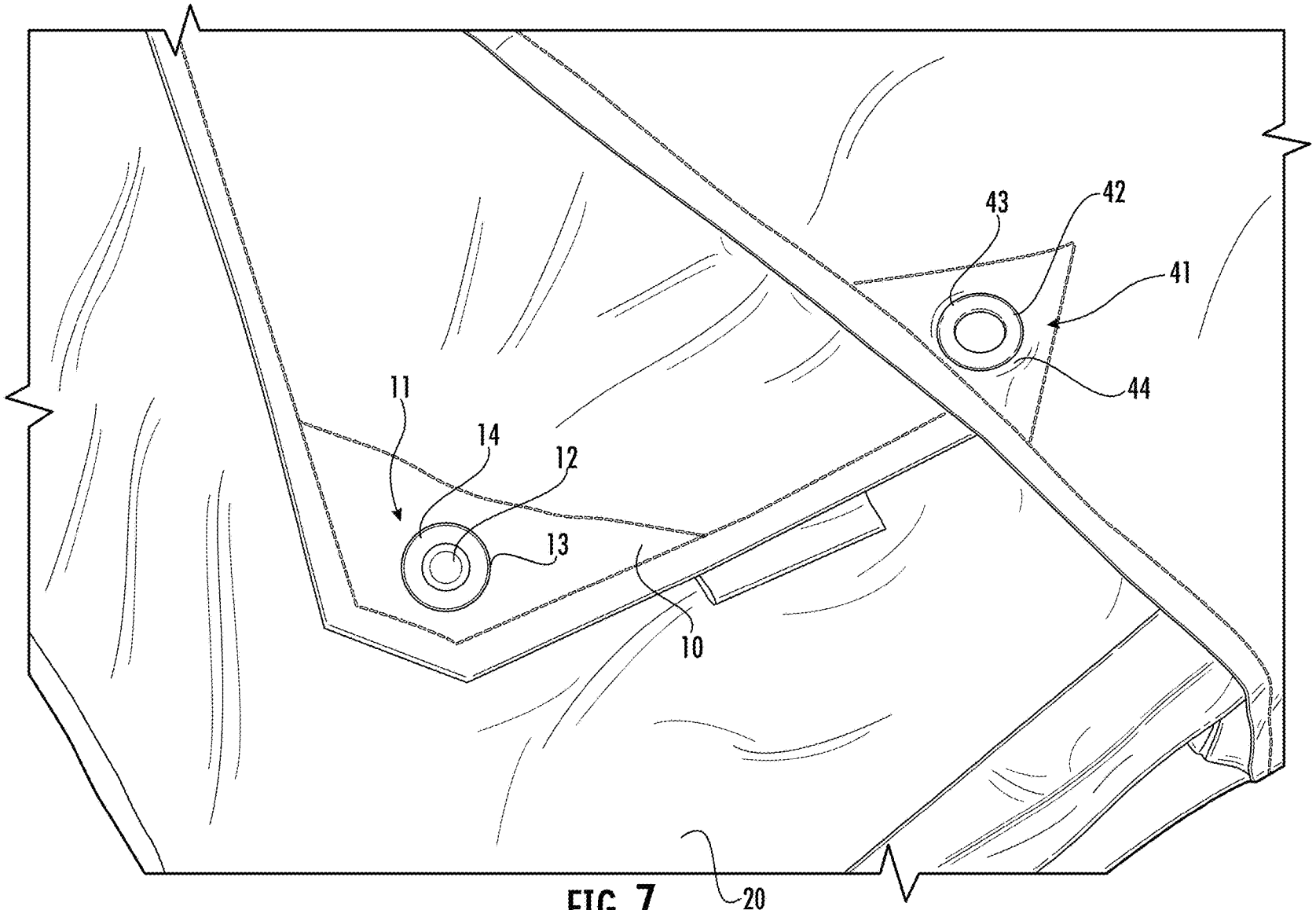
FIG. 7 is a view showing components of the full bedding system according to the invention.

FIG. 7 is a view showing the essential components of the bedding system according to the invention. In particular, the mattress cover 20 is shown including the strap 24 connected to the mattress cover 20 at the anchoring point 22. The cover fastener part 21 is also shown. The sheet 10 is shown with fastener part 11, including base part 13 connected to the sheet 10 at anchored point 14, as well as the stud 12. Also shown is an optional upper bedding part or top sheet 40, which includes a top sheet fastener generally designated 41. The top sheet fastener 41 includes a ring structure (such as a plastic ring structure) 42 which is fixedly attached to the top sheet 40 at an anchor location 44. The anchor location 44 may include a reinforced fabric part 45 (FIG. 3) which is bound to the base part 44. The top sheet connector 11 includes an opening 43, which is configured to receive the stud 12 of the cover fastener 11. Preferably two top sheet fasteners 41 are provided, in particular at each of two lower corners of the top sheet 40.

The top sheet 40 may be a simple top sheet or may be a duvet cover or other bedding parts such as a duvet, a comforter, a blanket or other bedding feature. The top sheet fasteners 41 may be spaced apart to provide a taught distance between the two top sheet connectors 41. The top sheet fasteners 41 may also be spaced apart a larger distance to provide extra space between the top sheet connectors 41, so as to not provide too much of a tensioning of the top sheet between the top sheet fasteners 41. The top sheet 40 or other bedding feature 40 may have a spacing between top sheet fasteners 41 to allow for a loose or taught positioning of the lower end of the top sheet for other bedding feature 40, to suit the taste of the user. In either case, the top sheet fasteners 41, in a connected state, maintain a basic position of the top sheet 40 or other bedding feature 40 relative to the mattress 1.

Figure 8:
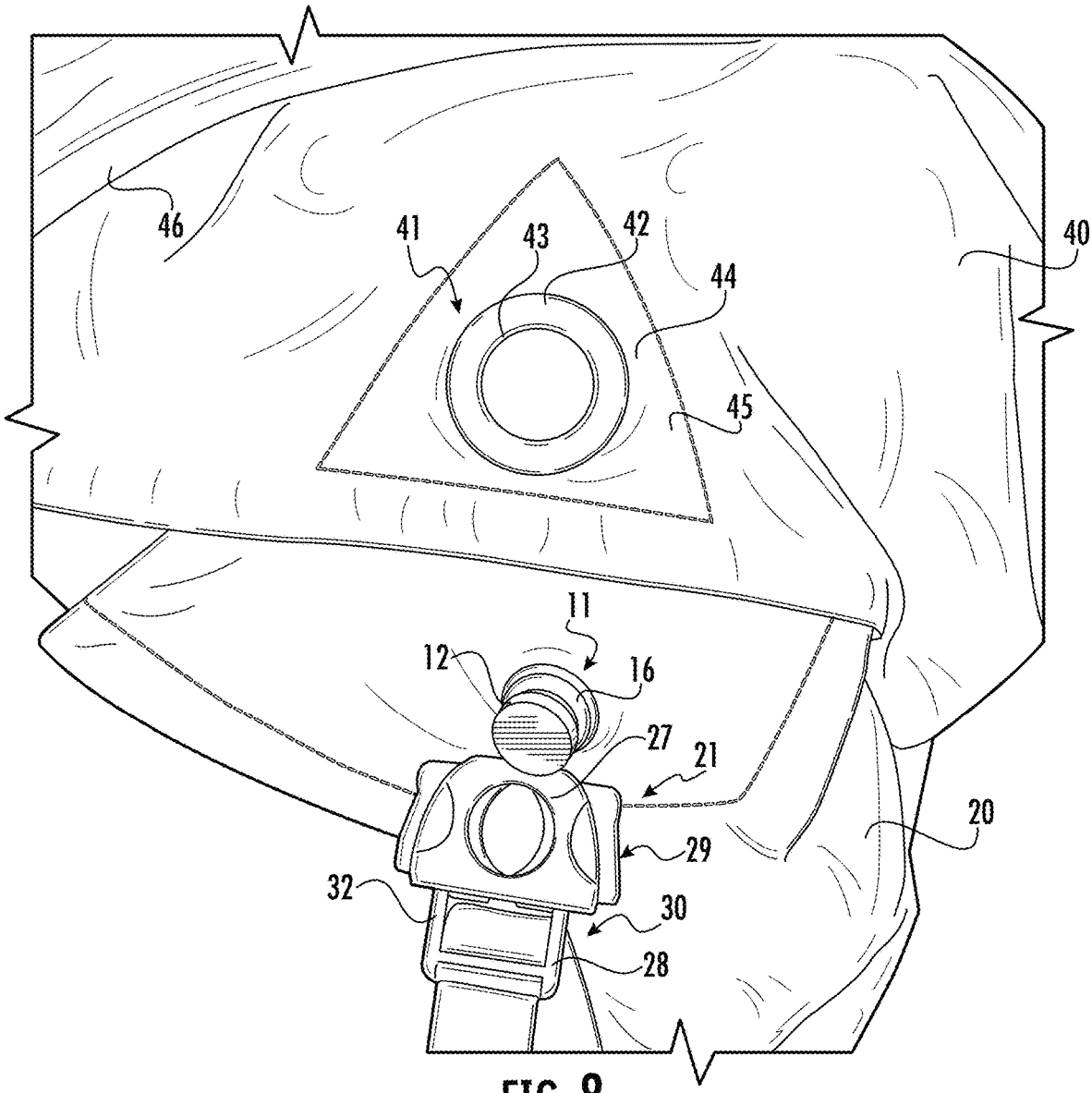
FIG. 8 is a perspective view showing the cover fastener with adjustment arrangement, the sheet fastener, in the form of a knob-shaped stud, and a top sheet fastener, all shown in a position ready to be connected.
Figure 9:
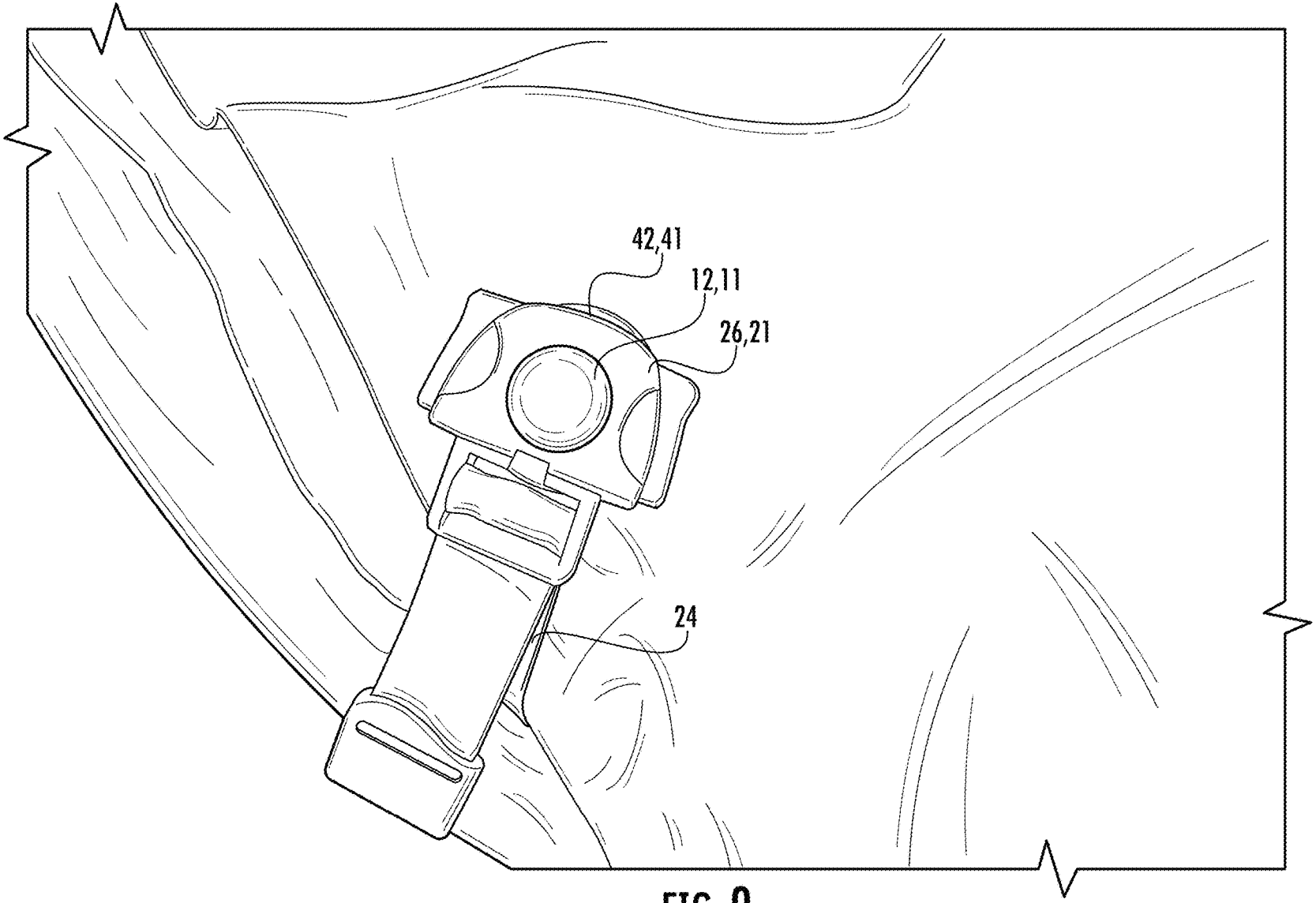
FIG. 9 is a perspective view showing the connected cover fastener, sheet fastener and top sheet fastener.

FIG. 8 shows the cover fastener 21, the sheet fastener 11, and the top sheet fastener 41 in position just prior to connection. When using each aspect of the system, including mattress cover 20, sheet (bottom sheet) 10 and top sheet 40, the top sheet fastener 41 is first placed over the sheet fastener 11 such that the stud 12 passes through the top sheet fastener opening 43 of the ring structure 42. Preferably the stud 12 and/or the base part 14 are configured to provide a retaining surface 16, about which an inner edge of the opening 43 snugly fits around and is seated on the retaining surface 16. This provides a seating of the top sheet fastener 41 relative to the stud 12 of the sheet fastener 11. This seating of the top sheet fastener 41 also avoids any interference between the connection of the remainder of the stud 12 inside the latching opening 27 of the cover fastener 21. Subsequent to seating the top sheet faster at 41 relative to the stud 12 of the sheet fastener 11, the cover fastener 12 is engaged the stud 12 such that stud 12 passes into the latching opening 27, with the actuator 29 opening the latching opening 27. The actuator 29 is then released to latch the cover fastener part 21 on the stud 12 of the sheet fastener part 11, with the sheet fastener 41 trapped between the base 14 of the sheet fastener 11 and the cover fastener 11. This connection of the three fasteners 21, 11 and 41 is shown in FIG. 9. An optional top sheet corner fabric cover 46 may be a triangular fabric portion 4*b* (FIG. 8) connected to the top sheet 40 and configured to cover over the top sheet fastener 41, the cover fastener 21, and the sheet fastener 11, after these fasteners are connected as shown in FIG. 9.

Figure 10:
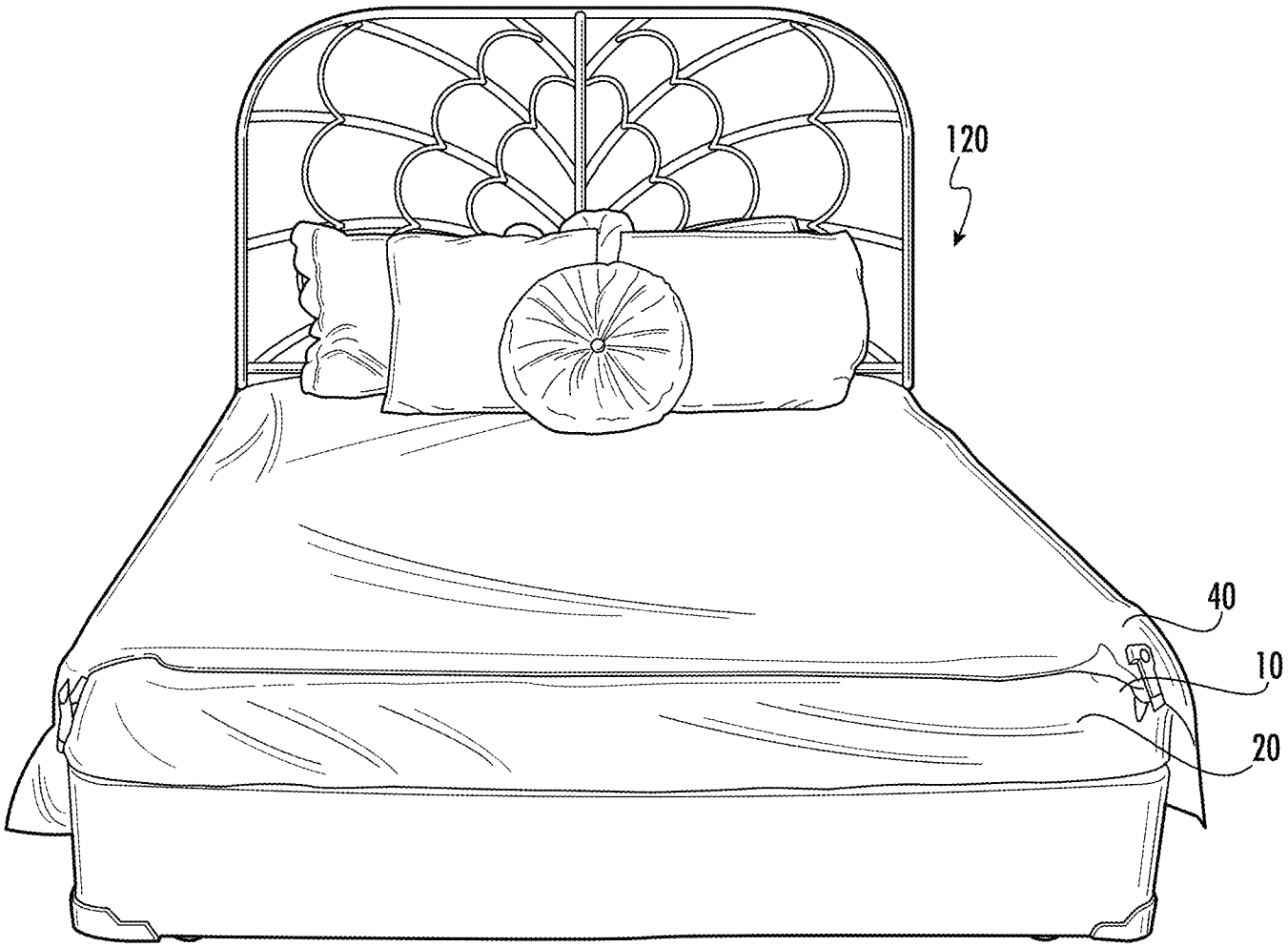
FIG. 10 is a perspective view showing a cover sheet, top sheet and mattress cover connected and in a position for use.

FIG. 10 shows the mattress system 120 in a deployed state, with the mattress cover 20 fitted over the mattress 1, with the sheet 10 connected in each of four corners based on the cover fasteners 21 connected to the sheet fasteners 11 and with the two lower ends of the top sheet 40 respectively connected to corresponding cover fasteners 21 and sheet fasteners 11.

According to the invention the process comprises various steps including providing a mattress cover. The mattress cover is configured to be fitted with the mattress over corners of the mattress. A plurality of cover fastener parts connected to the mattress cover are provided at locations coinciding with or adjacent to the corners of the mattress. The mattress cover could also be configured as one that elastically fitted to the corners of a mattress or one that utilizes bands or straps to secure it to the mattress. The mattress cover may also incorporate a waterproof mattress protector. The mattress protector could be configured to affix onto the mattress cover with velcro or other fastening means. The mattress cover can be configured to different sizes, for instance one that could fit a mattress for a baby crib. A sheet is configured to sit atop the mattress cover and has corner portions to be positioned at or adjacent to the corners of the mattress. A plurality of sheet fastener parts are connected to the sheet at locations coinciding with or adjacent to the corners of the sheet, each of the sheet fastener parts being connectable with an associated one of the cover fasteners parts. The cover fasters may also be integrated with or directly connected to the mattress. The sheet is applied to sit atop the mattress. Lastly, the respective cover fastener parts are connected to the respective sheet fastener parts.

The process for changing sheets of a mattress may further comprise providing straps connected to the mattress cover at anchoring points, wherein each of the cover fastener parts is connected to the mattress at locations coinciding with or adjacent to the corners of the mattress by a respective strap. This allows movement of the cover fastener parts relative to the anchor points.

Each of the straps maybe configured with a cover fastener part adjustment arrangement to adjust a position of the cover fastener part relative to the respective anchoring point. The process may also comprise providing an elastic strap to adjust a position of the cover fastener part relative to the respective anchoring point.

The cover fastener part adjustment arrangement may comprise a strap adjuster connected to the respective cover fastener part. The strap adjuster may comprise a plurality of strap passage openings to adjust a position of the respective cover fastener part along a length of the respective strap.

The anchoring points may comprise a stitched connection of the strap to the mattress cover and/or a reinforced portion supporting and/or covering the connection of the respective strap and the mattress cover.

The cover fastener parts may each comprise a buckle clip defining a latching clip opening with a latching clip and the sheet fastener parts each comprise a knob-shaped stud configured to be received in the latching clip opening and retained therein with the latching clip. The sheet is held in position relative to the mattress cover upon connection of the cover fastener parts with the respective sheet fastener parts.

The cover fastener parts may each comprise one of a hook or a loop configuration, hook and loop fastener portion. The sheet fastener parts also each comprise the other of a hook or a loop configuration, hook and loop fastener portion. Upon connection of the cover fastener parts with the respective sheet fastener parts, the sheet is held in position relative to the mattress cover. The sheet is reinforced at locations at which the sheet fastener parts are connected to the sheet.

The process for changing sheets may further provide a top sheet configured to sit atop the sheet that has corner portions to be positioned at or adjacent to the corners of the sheet. Additionally, a plurality of top sheet fastener parts may respectively be connected to the top sheet at locations coinciding with or adjacent to two of the corners of the top sheet, each of the top sheet fastener parts being connectable with an associated one of the cover fasteners parts. It may be advantageous for the that the top sheet rings to angle inward from the corners of the top sheet to align with the corners of the mattress in a case where the top sheet is wider than the mattress.

While specific embodiments of the invention have been shown and described in detail to illustrate the application of the principles of the invention, it will be understood that the invention may be embodied otherwise without departing from such principles.

LIST OF REFERENCE NUMBERS

1 mattress
10 sheet
11 sheet fastener part
12 stud
13 anchor location
14 base portion
20 mattress cover
21 cover fastener part
22 anchoring point
24 strap
25 pocket structure
26 fastener
27 latching clip opening
28 strap opening
29 actuator
30 adjusting arrangement
32 strap adjuster
40 optional top sheet (upper bedding part)
41 top sheet connector top sheet fastener
42 ring structure
43 opening
44 anchor location base part
45 fabric part
46 top sheet corner fabric cover
100 bedding connection device
120 bedding system

What is claimed is:

1. A bedding connection device for applying bedding to a mattress, the device comprising:

a mattress cover, wherein the mattress cover is configured to be fitted with the mattress over corners of the mattress;

a plurality of cover fastener parts connected to the mattress cover at locations coinciding with or adjacent to the corners of the mattress;

a sheet configured to sit atop the mattress cover and having corner portions to be positioned at or adjacent to the corners of the mattress;

a plurality of sheet fastener parts respectively connected to the sheet at locations coinciding with or adjacent to the corners of the sheet, each of the sheet fastener parts being connectable with an associated one of the cover fasteners parts; and straps connected to the mattress cover at anchoring points, wherein each of the cover fastener parts is connected to the mattress cover at locations coinciding with or adjacent to the corners of the mattress by a respective strap, allowing movement of the cover fastener parts relative to the anchor points, wherein the cover fastener parts each comprise a buckle clip defining a latching clip opening with a latching clip and the sheet fastener parts each comprise a knob-shaped stud configured to be received in the latching clip opening and retained therein with the latching clip, whereby upon connection of the cover fastener parts with the respective sheet fastener parts the sheet is held in position relative to the mattress cover.

2. The bedding connection device of claim 1, wherein each of the straps is configured with a cover fastener part adjustment arrangement to adjust a position of the cover fastener part relative to the respective anchoring point and/or each of the straps comprises an elastic strap to adjust a position of the cover fastener part relative to the respective anchoring point.

3. The bedding connection device of claim 2, wherein the cover fastener part adjustment arrangement comprises a strap adjuster connected to the respective cover fastener part, the strap adjuster comprising a plurality of strap passage openings to adjust a position of the respective cover fastener part along a length of the respective strap.

4. The bedding connection device of 1, wherein the anchoring points comprise a stitched connection of the strap to the mattress cover and/or a reinforced portion supporting and/or covering the connection of the respective strap and the mattress cover.

5. The bedding connection device of claim 1, wherein the sheet is reinforced at locations at which the sheet fastener parts are connected to the sheet.

6. The bedding connection device of claim 1, further comprising:

an upper bedding part configured to sit atop the sheet and having corner portions to be positioned at or adjacent to at least some of the corners of the sheet; and a plurality of upper bedding fastener parts respectively connected to the upper bedding part at locations coinciding with or adjacent to two of the corners of the upper bedding part, each of the upper bedding fastener parts being connectable with an associated one of the cover fasteners parts by the knob-shaped stud of an associated one of the sheet fastener parts.

7. The bedding connection device of claim 6, wherein the upper bedding part is reinforced at locations at which the upper bedding fastener parts are connected to the upper bedding part and/or the upper bedding part comprises a fastener cover portion to at least partially cover the respective upper bedding fastener.

8. A system for applying bedding to a mattress, the system comprising:

a mattress;

a mattress cover, wherein the mattress cover is configured to be fitted with the mattress over corners of the mattress;

a plurality of cover fastener parts connected to the mattress cover at locations coinciding with or adjacent to the corners of the mattress;

a sheet configured to sit atop the mattress cover and having corner portions to be positioned at or adjacent to the corners of the mattress;

a plurality of sheet fastener parts respectively connected to the sheet at locations coinciding with or adjacent to the corners of the sheet, each of the sheet fastener parts being connectable with an associated one of the cover fasteners parts; and a plurality of straps connected to the mattress cover at anchoring points, wherein each of the cover fastener parts is connected to the mattress cover at locations coinciding with or adjacent to the corners of the mattress by a respective strap, allowing movement of the cover fastener parts relative to the anchor points, wherein the cover fastener parts each comprise a buckle clip defining a latching clip opening with a latching clip and the sheet fastener parts each comprise a knob-shaped stud configured to be received in the latching clip opening and retained therein with the latching clip, whereby upon connection of the cover fastener parts with the respective sheet fastener parts the sheet is held in position relative to the mattress cover.

9. The bedding connection device of claim 8, wherein each of the plurality of straps is configured with a cover fastener part adjustment arrangement to adjust a position of the cover fastener part relative to the respective anchoring point and/or each of the plurality of straps comprises an elastic strap to adjust a position of the cover fastener part relative to the respective anchoring point.

10. The bedding connection device of claim 9, wherein the cover fastener part adjustment arrangement comprises a strap adjuster connected to the respective cover fastener part, the strap adjuster comprising a plurality of strap passage openings to adjust a position of the respective cover fastener part along a length of the respective strap, wherein the anchoring points comprise a stitched connection of the strap to the mattress cover and/or a reinforced portion supporting and/or covering the connection of the respective strap and the mattress cover.

11. The bedding connection device of claim 8, further comprising:

an upper bedding part configured to sit atop the sheet and having corner portions to be positioned at or adjacent to at least some of the corners of the sheet; and a plurality of upper bedding fastener parts respectively connected to the upper bedding part at locations coinciding with or adjacent to two of the corners of the upper bedding part, each of the upper bedding fastener parts being connectable with an associated one of the cover fasteners parts by the knob-shaped stud of an associated one of the sheet fastener parts.

12. The bedding connection device of claim 11, wherein the upper bedding part is reinforced at locations at which the upper bedding fastener parts are connected to the upper bedding part and/or the upper bedding part comprises a fastener cover portion to at least partially cover the respective upper bedding fastener, the cover fastener part and the knob-shaped stud of an associated one of the sheet fastener parts.

13. A bedding connection device for applying bedding to a mattress, the device comprising:

a mattress cover, wherein the mattress cover is configured to be fitted with the mattress over corners of the mattress;

straps connected to the mattress cover at anchoring points;

a plurality of cover fastener parts, each connected to the mattress cover at locations coinciding with or adjacent to the corners of the mattress by a respective one of the straps, allowing movement of the cover fastener parts relative to the anchoring points, a sheet configured to sit atop the mattress cover and having corner portions to be positioned at or adjacent to the corners of the mattress;

a plurality of sheet fastener parts respectively connected to the sheet at locations coinciding with or adjacent to the corners of the sheet, wherein the cover fastener parts each comprise a buckle clip defining a latching clip opening with a latching clip, and the sheet fastener parts each comprise a knob-shaped stud configured to be received in the latching clip opening and retained therein with the latching clip, whereby upon connection of the cover fastener parts with the respective sheet fastener parts the sheet is held in position relative to the mattress cover;

an upper bedding part configured to sit atop the sheet and having corner portions to be positioned at or adjacent to at least some of the corners of the sheet; and a plurality of upper bedding fastener parts respectively connected to the upper bedding part at locations coinciding with or adjacent to two of the corners of the upper bedding part, wherein in a state with respective buckle clips connected to the knob-shaped stud s of the sheet fastener parts associated with the two of the corners, each of the upper bedding fastener parts is connectable with an associated one of the cover fasteners parts, at the two corners, by the knob-shaped stud of an associated one of the sheet fastener parts.

14. The bedding connection device of claim 13, wherein the upper bedding part is reinforced at locations at which the upper bedding fastener parts are connected to the upper bedding part and/or the upper bedding part comprises a fastener cover portion to at least partially cover the respective upper bedding fastener.

15. The bedding connection device of claim 13, wherein each of the straps is configured with a cover fastener part adjustment arrangement to adjust a position of the cover fastener part relative to the respective anchoring point and or comprises an elastic strap to adjust a position of the cover fastener part relative to the respective anchoring point.

16. The bedding connection device of claim 13, wherein the cover fastener part adjustment arrangement comprises a strap adjuster connected to the respective cover fastener part, the strap adjuster comprising a plurality of strap passage openings to adjust a position of the respective cover fastener part along a length of the respective strap.

* * * * *